US010974378B2

(12) United States Patent
Pedicini

(10) Patent No.: US 10,974,378 B2
(45) Date of Patent: Apr. 13, 2021

(54) FASTENER DRIVING APPARATUS

(71) Applicant: Tricord Solutions, Inc., Franklin, TN (US)

(72) Inventor: Christopher Pedicini, Franklin, TN (US)

(73) Assignee: Tricord Solutions, Inc., Franklin, TN (US)

( * ) Notice: Subject to any disclaimer, the term of this patent is extended or adjusted under 35 U.S.C. 154(b) by 147 days.

(21) Appl. No.: 15/889,199

(22) Filed: Feb. 5, 2018

(65) Prior Publication Data

US 2019/0039218 A1 Feb. 7, 2019

Related U.S. Application Data

(60) Provisional application No. 62/454,258, filed on Feb. 3, 2017.

(51) Int. Cl.
*B25C 1/04* (2006.01)
*B25C 1/00* (2006.01)
*B25C 1/06* (2006.01)

(52) U.S. Cl.
CPC ..... *B25C 1/008* (2013.01); *B25C 1/047* (2013.01); *B25C 1/06* (2013.01)

(58) Field of Classification Search
CPC ..... B25C 1/06; B25C 1/047
USPC ..... 227/4; 173/128, 4
See application file for complete search history.

(56) References Cited

U.S. PATENT DOCUMENTS 3,172,121 A * 3/1965 Doyle ..... B25C 1/06 310/16
3,589,588 A * 6/1971 Vasku ..... B25C 1/005 227/132
3,847,322 A * 11/1974 Smith ..... B25C 1/06 227/132
4,161,272 A * 7/1979 Brockl ..... B25C 1/06 227/131
4,204,622 A * 5/1980 Smith ..... B25C 1/003 173/1
4,215,808 A * 8/1980 Sollberger ..... B25C 1/041 173/204
4,807,793 A * 2/1989 Ghibely ..... B25C 5/15 227/131
5,320,270 A * 6/1994 Crutcher ..... B25C 1/06 227/131
5,503,319 A * 4/1996 Lai ..... B25C 5/15 173/203
5,511,715 A * 4/1996 Crutcher ..... B25C 1/06 227/131

(Continued)

*Primary Examiner* — Gloria R Weeks
(74) *Attorney, Agent, or Firm* — Aidenbaum Schloff and Bloom PLLC; Jay Schloff

(57) ABSTRACT

A fastener driving apparatus includes a spring anvil assembly and an elastomer. The elastomer is capable of being energized under tension or under compression. A drive mechanism acts on the spring anvil assembly and/or anvil to store potential energy in the spring. The drive mechanism thereafter ceases acting on the spring anvil assembly and/or anvil and the potential energy accumulated in the elastomer is released, causing the spring anvil assembly and/or anvil move and to separate from the drive mechanism for a period of free flight of the spring anvil assembly, the anvil thereafter moving to strike a fastener to drive the fastener into a substrate.

21 Claims, 2 Drawing Sheets

(56) References Cited

U.S. PATENT DOCUMENTS 5,720,423 A * 2/1998 Kondo ..... B25C 1/04 227/130
6,997,367 B2 * 2/2006 Hu ..... B25C 1/06 173/202
7,537,145 B2 * 5/2009 Gross ..... B25C 1/06 227/120
7,537,146 B2 * 5/2009 Schiestl ..... B25C 1/06 227/131
7,543,728 B2 * 6/2009 Spasov ..... B25C 1/06 173/202
7,575,142 B2 * 8/2009 Liang ..... B25C 1/06 227/129
7,992,756 B2 * 8/2011 Franz ..... B25C 5/15 227/131
8,079,504 B1 * 12/2011 Pedicini ..... B25C 1/06 227/130
8,602,282 B2 * 12/2013 Leimbach ..... B25C 1/041 227/8
8,733,610 B2 * 5/2014 Pedicini ..... B25C 5/15 173/201
8,875,969 B2 * 11/2014 Pedicini ..... B25C 1/04 227/10
9,687,975 B2 * 6/2017 Dittrich ..... B25C 1/08
2004/0232194 A1 * 11/2004 Pedicini ..... B25C 1/06 227/131
2009/0032566 A1 * 2/2009 Liang ..... B25C 1/06 227/131
2012/0211540 A1 * 8/2012 Kondou ..... B25C 1/06 227/140
2012/0325887 A1 * 12/2012 Wolf ..... B25C 1/06 227/146
2013/0334277 A1 * 12/2013 Shima ..... B25F 5/00 227/131
2015/0375381 A1 * 12/2015 Tanji ..... B25F 5/006 227/146
2016/0096259 A1 * 4/2016 Pedicini ..... B25C 1/047 227/146
2016/0288305 A1 * 10/2016 McCardle ..... B25C 1/06

* cited by examiner

FASTENER DRIVING APPARATUS

CROSS REFERENCE TO RELATED APPLICATIONS

The present disclosure claims priority under 35 United States Code, Section 119 on the U.S. Provisional Patent Application Ser. No. 62/454,258, filed on Feb. 3, 2017, the disclosure of which is incorporated by reference.

FIELD OF THE DISCLOSURE

The present disclosure relates to fastener driving apparatuses, and, more particularly, to such fastener or staple driving mechanisms that require operation as a hand tool.

BACKGROUND

Electromechanical fastener driving apparatuses (also referred to herein as a "driver," "gun" or "device") known in the art often weigh generally less than 15 pounds and may be configured for an entirely portable operation. Contractors and homeowners commonly use power-assisted devices and means of driving fasteners into wood. These power-assisted means of driving fasteners can be either in the form of finishing fastener systems used in baseboards or crown molding in house and household projects, or in the form of common fastener systems that are used to make walls or hang sheathing onto same. These systems can be portable (i.e., not connected or tethered to an air compressor or wall outlet) or non-portable.

The most common fastener driving apparatus uses a source of compressed air to actuate a guide assembly to push a fastener into a substrate. For applications in which portability is not required, this is a very functional system and allows rapid delivery of fasteners for quick assembly. A disadvantage is that it does however require that the user purchase an air compressor and associated air-lines in order to use this system. A further disadvantage is the inconvenience of the device being tethered (through an air hose) to an air compressor.

To solve this problem, several types of portable fastener drivers operate off of fuel cells. Typically, these guns have a guide assembly in which a fuel is introduced along with oxygen from the air. The subsequent mixture is ignited with the resulting expansion of gases pushing the guide assembly and thus driving the fastener into the workpieces. This design is complicated and is far more expensive than a standard pneumatic fastener gun. Both electricity and fuel are required as the spark source derives its energy typically from batteries. The chambering of an explosive mixture of fuel, the use of consumable fuel cartridges, the loud report and the release of combustion products are all disadvantages of this solution. Systems such as these are already in existence and are sold commercially to contractors under the Paslode™ name.

Another commercially available solution is a fastener gun that uses electrical energy to drive a stapler or wire brad. Such units typically use a solenoid to drive the fastener (such as those commercially available under the Arrow™ name or those that use a ratcheting spring system such as the Ryobi™ electric stapler). These units are limited to short fasteners (typically 1" or less), are subject to high reactionary forces on the user and are limited in their repetition rate. The high reactionary force is a consequence of the comparatively long time it takes to drive the fastener into the substrate. Additionally, because of the use of mechanical springs or solenoids, the ability to drive longer fasteners or larger fasteners is severely restricted, thus relegating these devices to a limited range of applications. A further disadvantage of the solenoid driven units is they often must be plugged into the wall in order to have enough voltage to create the force needed to drive even short fasteners.

A final commercially available solution is to use a flywheel mechanism and clutch the flywheel to an anvil that drives the fastener. Examples of such tools can be found under the Dewalt™ name. This tool is capable of driving the fasteners very quickly and in the longer sizes. The primary drawback to such a tool is the large weight and size as compared to the pneumatic counterpart. Additionally, the drive mechanism is very complicated, which gives a high retail cost in comparison to the pneumatic fastener gun.

Clearly based on the above efforts, a need exists to provide portable solution to driving fasteners that is unencumbered by fuel cells or air hoses. Additionally, the solution ought to provide a low reactionary feel, be able to drive full size fasteners and be simple, cost effective and robust in operation.

The prior art teaches several additional ways of driving a fastener or staple. The first technique is based on a multiple impact design. In this design, a motor or other power source is connected to an impact anvil through either a lost motion coupling or other device. This allows the power source to make multiple impacts on the fastener to drive it into the workpiece. The disadvantages in this design include increased operator fatigue since the actuation technique is a series of blows rather than a single drive motion. A further disadvantage is that this technique requires the use of an energy absorbing mechanism once the fastener is seated. This is needed to prevent the anvil from causing excessive damage to the substrate as it seats the fastener. Additionally, the multiple impact designs are not very efficient because of the constant motion reversal and the limited operator production speed.

A second design that is taught in U.S. Pat. Nos. 3,589,588, 5,503,319, and 3,172,121 includes the use of potential energy storage mechanisms (in the form of a mechanical spring). In these designs, the spring is cocked (or activated) through an electric motor. Once the spring is sufficiently compressed, the energy is released from the spring into the anvil (or fastener driving piece), thus pushing the fastener into the substrate. Several drawbacks exist to this design. These include the need for a complex system of compressing and controlling the spring, and in order to store sufficient energy, the spring must be very heavy and bulky. Additionally, the spring suffers from fatigue, which gives the tool a very short life. Finally, metal springs must move a significant amount of mass in order to decompress, and the result is that these low-speed fastener drivers result in a high reactionary force on the user.

To improve upon this design, an air spring has been used to replace the mechanical spring. U.S. Pat. No. 4,215,808 teaches of compressing air within a guide assembly and then releasing the compressed air by use of a gear drive. This patent overcomes some of the problems associated with the mechanical spring driven fasteners described above, but is subject to other limitations. One particular troublesome issue with this design is the safety hazard in the event that the anvil jams on the downward stroke. If the fastener jams or buckles within the feeder and the operator tries to clear the jam, he is subject to the full force of the anvil, since the anvil is predisposed to the down position in all of these types of devices. A further disadvantage presented is that the fastener must be fed once the anvil clears the fastener on the backward stroke. The amount of time to feed the fastener is limited and can result in jams and poor operation, especially with longer fasteners. A further disadvantage to the air spring results from the need to have the ratcheting mechanism as part of the anvil drive. This mechanism adds weight and causes significant problems in controlling the fastener drive since the weight must be stopped at the end of the stroke. This added mass slows the fastener drive stroke and increases the reactionary force on the operator. Additionally, because significant kinetic energy is contained within the air spring and piston assembly the unit suffers from poor efficiency. This design is further subject to a complicated drive system for coupling and uncoupling the air spring and ratchet from the drive train that increases the production cost and reduces the system reliability.

U.S. Pat. No. 5,720,423 again teaches of an air spring that is compressed and then released to drive the fastener. The drive or compression mechanism used in this device is limited in stroke and thus is limited in the amount of energy that can be stored into the air stream. In order to provide sufficient energy in the air stream to achieve good performance, this patent teaches use of a gas supply that preloads the guide assembly at a pressure higher than atmospheric pressure. Furthermore, the compression mechanism is bulky and complicated. In addition, the timing of the motor is complicated by the small amount of time between the release of the piston and anvil assembly from the drive mechanism and its subsequent re-engagement. Additionally, U.S. Pat. No. 5,720,423 teaches that the anvil begins in the retracted position, which further complicates and increases the size of the drive mechanism. Furthermore, because of the method of activation, these types of mechanisms as described in U.S. Pat. Nos. 5,720,423 and 4,215,808 must compress the air to full energy and then release off the tip of the gear while under full load. This method of compression and release causes severe mechanism wear. As will be discussed below, the present disclosure overcomes these and other limitations in the prior art use of air springs.

A third means for driving a fastener that is taught includes the use of flywheels as energy storage means. The flywheels are used to actuate a hammering anvil that impacts the fastener. This design is described in detail in U.S. Pat. Nos. 4,042,036, 5,511,715, and 5,320,270. One major drawback to this design is the problem of coupling the flywheel to the driving anvil. This prior art teaches the use of a friction clutching mechanism that is both complicated, heavy and subject to wear. Further limiting this approach is the difficulty in controlling the energy in the fastener system. The mechanism requires enough energy to drive the fastener, but retains significant energy in the flywheel after the drive is complete. This further increases the design complexity and size of such prior art devices.

A fourth means for driving a fastener is taught in the present inventors' U.S. Pat. No. 8,079,504, which uses a compression on demand system with a magnetic detent. This system overcomes many of the advantages of the previous systems but still has its own set of disadvantages that include the need to retain a very high pressure for a short period of time. This pressure and subsequent force necessitate the use of high strength components and more expensive batteries and motors.

A fifth means is taught in U.S. Pat. No. 8,733,610, which uses a vacuum to drive a fastener drive assembly. This clearly has its own advantages over the previous systems but has its own set of disadvantages, including the need to retain a seal against air pressure. This sealing requirement necessitates the use of more accurate cylinders and pistons, thus contributing to the manufacturing cost.

A sixth means taught in U.S. Pat. No. 8,602,282 clearly teaches a gas spring wherein the gas spring traverses the entire stroke of the drive anvil and wherein the spring is energized during the entire stroke. This means is similar to what is used in US Patent Application Publication 2012/0325887 wherein a flywheel or gyrating mass has been added to what is disclosed in U.S. Pat. No. 8,602,282. Both of these patents clearly have sets of disadvantages when it comes to safety, as the anvil or hammer mechanism is fully powered under the down stroke. Additionally, these references teach of a gas spring drive that remains connected the anvil the entire time of operation and thus has efficiency losses and wear due to seal issues. Furthermore, the integration of a clutch and a gyrating mass causes spool up issues and can further reduce efficiency.

All of the currently available devices suffer from one or more the following disadvantages:

- Complex, expensive and unreliable designs. Fuel powered mechanisms such as Paslode™ achieve portability but require consumable fuels and are expensive. Rotating flywheel designs such as Dewalt™ have complicated coupling or clutching mechanisms based on frictional means. This adds to their expense.
- Poor ergonomics. The fuel powered mechanisms have loud combustion reports and combustion fumes. The multiple impact devices are fatiguing and are noisy.
- Non-portability. Traditional fastener guns are tethered to a fixed compressor and thus must maintain a separate supply line.
- High reaction force and short life. Mechanical spring driven mechanisms have high tool reaction forces because of their long fastener drive times. Additionally, the springs are not rated for these types of duty cycles leading to premature failure. Furthermore, consumers are unhappy with their inability seat longer fasteners or work with denser wood species.
- Safety issues. The prior art "air spring" and heavy spring driven designs suffer from safety issues for longer fasteners since the predisposition of the anvil is towards the substrate. During jam clearing, this can cause the anvil to strike the operators hand.
- Low efficiency as a result of the need to spin up a large gyrating mass or gas springs which have strokes that are similar in length to the drive stroke of the fastener.

In light of these various disadvantages, there exists the need for a fastener driving apparatus that overcomes these various disadvantages of the prior art and can give a similar user experience to a pneumatic tool, while still retaining the benefits of the prior art.

SUMMARY OF THE DISCLOSURE

In accordance with the present disclosure, a fastener driving apparatus is described which derives its power from an electrical source (preferably rechargeable batteries), and uses a motor to actuate a spring anvil assembly. The spring anvil assembly further comprises an anvil and a spring, which spring may be an elastomeric spring or a mechanical spring, for example. The spring anvil assembly may be disposed during at least a portion of the operational cycle against an object that is capable of exerting a force against the spring (such as a plate, also referred to hereafter as a pusher surface). After sufficient potential energy has been stored in the spring the energy is released causing the spring anvil assembly to move, which anvil thereafter may strike a fastener to drive the fastener into a substrate.

In an embodiment, the pusher surface may comprise an elastomer. In such an embodiment, when the spring anvil assembly is loaded or disposed against the pusher surface by a drive mechanism, potential energy is generated within elastomer. When the drive mechanism ceases to act on the spring anvil assembly to load or dispose it against the pusher surface, the potential energy previously generated within the elastomer may then act on pusher surface to actuate the pusher surface, causing the spring anvil assembly to launch away from the pusher surface such that the anvil may impact and drive a fastener. In a further embodiment, the apparatus may comprise an anvil without a spring, which anvil may be loaded against the elastomeric pusher surface and which anvil may then be launched by the elastomeric pusher surface after potential energy has been generated within the pusher surface.

In a further embodiment, the spring anvil assembly or anvil impacts a bumper at one or both ends of the stroke to minimize any damage to the mechanism. A spring (mechanical or gas), a bungee or other return mechanism may incorporated to return the spring anvil assembly, after the anvil drives the fastener, to a position wherein the drive mechanism is able to again act on the spring anvil assembly spring for another fastener drive by the anvil. In a further embodiment, this return mechanism is part of the moving mass that improves efficiency.

By incorporating an elastic element in launched spring anvil assembly, it was unexpectedly discovered that efficiency of the apparatus was significantly improved over prior spring-driven fastener driving apparatuses. In a preferred embodiment, the energy density of the spring is at least 0.5 joules per gram. Further, the spring should have high resilience. In a preferred embodiment, the elastomeric spring has a resilience of at least 80%. In the embodiment, where the elastomer is in tension (i.e., part of the pusher surface), the elastomer is a low-loss elastomer with recoverable energy of at least 70%. Where the elastomer is part of the spring anvil assembly or anvil, the elastomer is preferably of high resilience.

The fastener driving cycle of the apparatus disclosed herein may start with an electrical signal, after which a circuit connects a motor to the electrical power source. The motor is coupled to the spring anvil assembly through a drive mechanism such as a cam or other actuating mechanism. In an operational cycle of the drive mechanism, the mechanism alternatively (1) energizes the spring anvil assembly or anvil such as by acting on a cam follower that is disposed, for example, on the spring anvil assembly and (2) decouples from the spring anvil assembly. For example, during a portion of its cycle, the drive mechanism may move the spring anvil assembly against the pusher surface to increase potential energy stored within pusher surface. In the next step of the cycle, the mechanism decouples from the spring anvil assembly to allow the accumulated potential energy within the pusher surface to act on, actuate and launch the spring anvil assembly and/or anvil. That is, the potential energy stored in the pusher surface or elastomer may convert into kinetic energy of the anvil to have the anvil drive a fastener. A spring or other return mechanism is operatively coupled to the spring anvil assembly to return the spring anvil assembly to an initial position. The drive mechanism may thereafter reengage the spring anvil assembly to again perform the operational cycle. In an embodiment, at least one bumper is disposed in proximity to the spring anvil assembly to reduce the wear on the apparatus. In an embodiment another bumper is used to reduce the wear on the anvil assembly that otherwise may occur in operation of the fastener driving apparatus. In a further embodiment, a bumper may be used between the spring anvil assembly and the pusher surface to reduce wear on the apparatus.

In another embodiment, the spring anvil assembly comprises an elastomer or a spring. The elastomer may be in the form of a compressible spring (sphere, cylindrical, or hourglass, for example) shape. The elastomer may be compressed against the pusher surface (by the drive mechanism, for example) to generate and store potential energy within the elastomer of the spring anvil assembly. After the elastomer is sufficiently compressed, the drive mechanism or other motive force may cease acting on the spring anvil assembly and/or elastomer to allow the elastomer to launch itself (and the spring anvil assembly) so that the anvil of the apparatus may drive a fastener. The elastomer may be part of the launched mass (which launched mass includes the anvil) or may be an element that does not itself launch along with the launched mass.

As used herein, an elastomer "in tension" refers to the embodiment where the elastomer is part of or in communication with the pusher surface. As used herein, an elastomer "in compression" refers to the embodiment where the elastomer is part of the spring anvil assembly.

In an embodiment, the stroke or movement of the elastomer in compression is less than one half the total movement of the anvil.

In an embodiment, a sensor and a control circuit are provided for determining at least one position of the spring anvil assembly, drive mechanism and/or anvil. The sensor may provide for enabling the proper timing for stopping the operational cycle or for re-energizing the elastomer of the apparatus. Further, this information can be used to detect a jam condition for proper recovery.

In an embodiment, the spring anvil assembly ceases to exert force on the pusher surface (or otherwise generates a sufficient amount of kinetic energy to thereafter allow the anvil to drive a fastener) at less than 40% of the total fastener stroke and preferably less than 5% of the fastener stroke. This results in an improved safety profile in the event of a jam, as the anvil will have dissipated its kinetic energy in the jam, thus allowing the user to fix the jam with minimal potential energy remaining in the spring anvil assembly. It was unexpectedly discovered that this also increases the efficiency and life of the apparatus. Seal friction is significant source of energy loss in pneumatics, by reducing the stroke of the spring anvil assembly efficiency is increased and seal wear is reduced.

In an embodiment, a locking mechanism (such as a sprocket and pawl or a one-way clutch) is used to provide an intermediate stopping point after the spring anvil assembly has been partially energized. This locking mechanism retains the drive mechanism and spring anvil assembly in place once power is removed from the motor. This allows a portion of the potential energy to be stored in the elastomer and thus reduces the latency of the apparatus. For purposes of the present disclosure, latency is defined as the period between a user initiated action such as a trigger pull and the delivery of a nail. In an embodiment, the latency is less than 100 milliseconds, which period appears to be instantaneous to the user.

Accordingly, and in addition to the objects and advantages of the portable electric fastener gun as described above, several objects and advantages of the present disclosure are:

To provide a simple design for driving fasteners that has a significantly lower production cost than currently available nail guns and that is portable and does not require an air compressor.

To provide a fastener driving device that mimics the pneumatic fastener performance without a tethered air compressor.

To provide an electrical driven high power fastening device that has very little wear.

To provide an electric motor driven fastener driving device in which energy is not stored behind the fastener driving anvil, thus greatly enhancing tool safety.

To provide an electric motor driven fastener in which the latency is reduced, thus improving the user experience.

To provide a more energy efficient mechanism for driving nails than is presently achievable with a compressed air or vacuum design.

These together with other aspects of the present disclosure, along with the various features of novelty that characterize the present disclosure, are pointed out with particularity in the claims annexed hereto and form a part of the present disclosure. For a better understanding of the present disclosure, its operating advantages, and the specific objects attained by its uses, reference should be made to the accompanying drawings and detailed description in which there are illustrated and described exemplary embodiments of the present disclosure.

DESCRIPTION OF THE DRAWINGS

The advantages and features of the present disclosure will become better understood with reference to the following detailed description and claims taken in conjunction with the accompanying drawings, in which:

DETAILED DESCRIPTION OF THE DISCLOSURE

Figure 1:
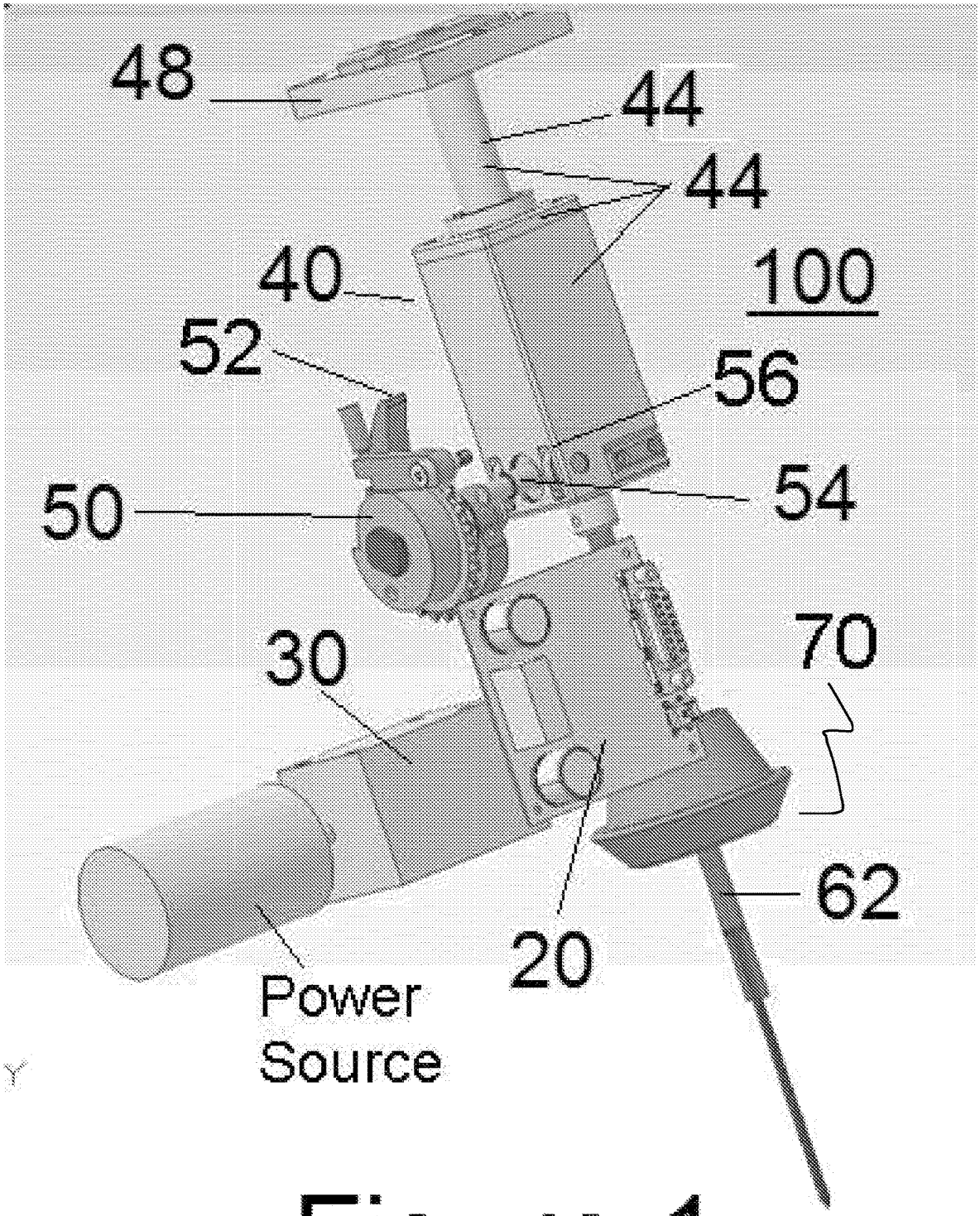
FIG. 1 shows a fastener driving apparatus comprising a pushing surface that comprises an elastomer, capable of being under tension in accordance with an exemplary embodiment of the present disclosure.
Figure 2:
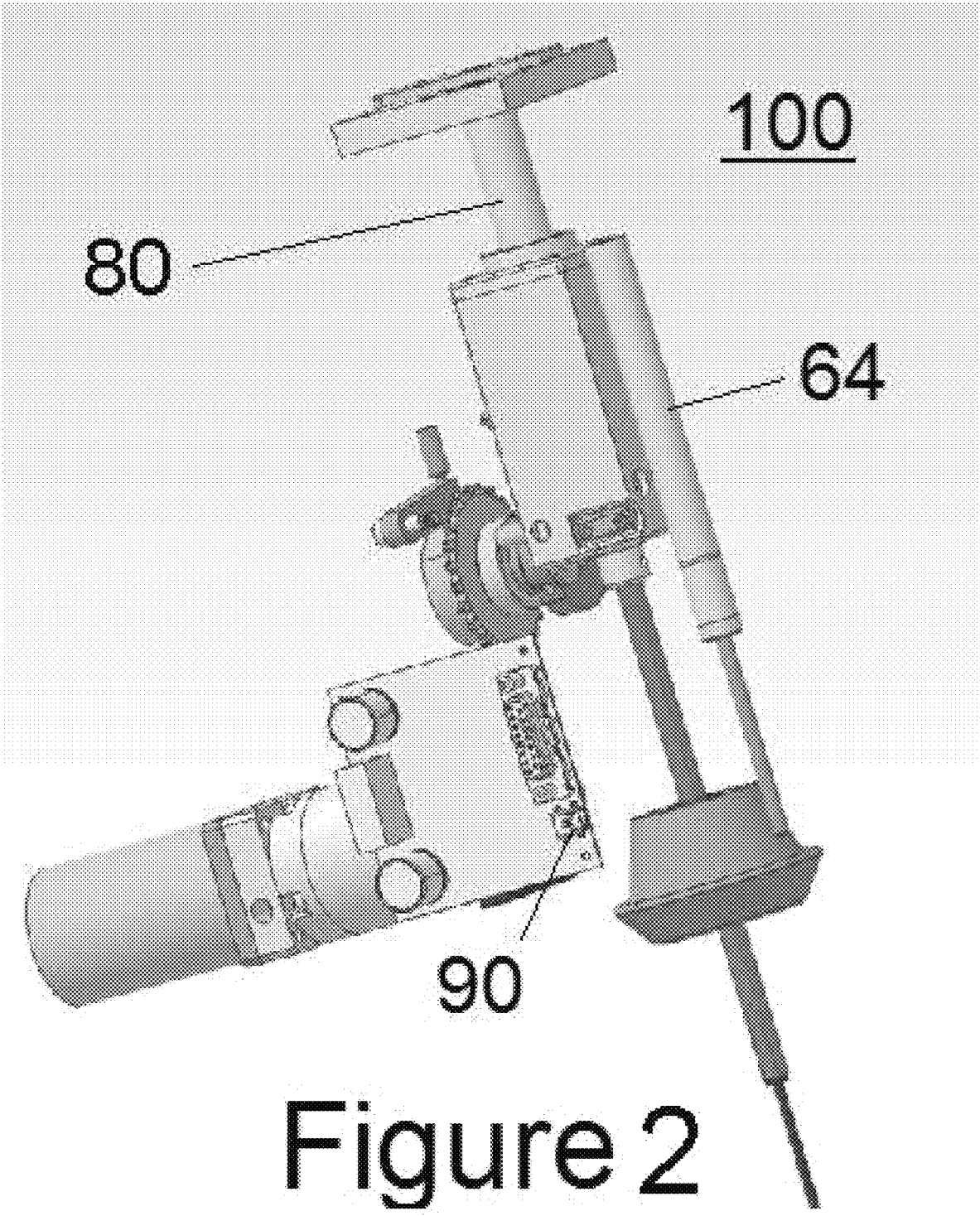
FIG. 2 shows a fastener driving apparatus comprising an elastomer, capable of being under compression in accordance with an exemplary embodiment of the present disclosure.

A mode for carrying out the present disclosure is presented in terms of its preferred embodiment, herein depicted in the accompanying figures. The preferred embodiments described herein detail for illustrative purposes are subject to many variations. It is understood that various omissions and substitutions of equivalents are contemplated as circumstances may suggest or render expedient, but are intended to cover the application or implementation without departing from the spirit or scope of the present disclosure. Furthermore, although the following relates substantially to one embodiment of the design, it will be understood by those familiar with the art that changes to materials, part descriptions and geometries can be made without departing from the spirit of the disclosure. It is further understood that references such as front, back or top dead center, bottom dead center do not refer to exact positions but approximate positions as understood in the context of the geometry in the attached figures.

The terms "a" and "an" herein do not denote a limitation of quantity, but rather denote the presence of at least one of the referenced items.

Referring to the figures, the present disclosure provides for a fastener driving apparatus 100. In an embodiment, the apparatus comprises a power source, a control circuit 20, a motor 30, a drive mechanism 50, a spring anvil assembly, an anvil return mechanism 64, and at least one bumper 70. The spring anvil assembly preferably comprises spring and/or an elastomer which spring and/or elastomer can store potential energy when the spring anvil assembly selectively actuated by the drive mechanism. The spring anvil assembly also may comprise an anvil assembly 44 (which includes an anvil 62). The anvil assembly may further include a contact point such as cam follower 54 for engagement and disengagement from the drive mechanism. A bumper 70 is in proximity to and preferably disposed within the spring anvil assembly absorbs a portion of the force of impact of the elastomer, spring and/or anvil during an operative cycle. The spring anvil assembly may make operative contact with a pusher surface 48 during a portion of the operational cycle of the apparatus. The pusher surface is simply a surface on which the spring anvil assembly acts or is loaded to provide a reactionary force against the spring anvil assembly and to generate potential energy. In an embodiment, the pusher surface comprises at least one elastomer, which at least one elastomer may store potential energy when the spring anvil assembly is loaded or disposed against the pusher surface by a drive mechanism. In an embodiment, the elastomer may be integral to the pusher surface. In another embodiment, the pusher surface is operatively coupled to the at least one elastomer, such as an elastomer that is disposed in proximity to the pusher surface and that is capable of communicating energy from the elastomer under tension to the pusher surface to move the pusher surface. When the drive mechanism ceases to act on the spring anvil assembly to load or dispose it against the pusher surface, the potential energy previously stored within the elastomer may be translated to the pusher surface, which pusher surface may then act on the spring anvil assembly to launch the spring anvil assembly such that the anvil may impact and drive a fastener. In a further embodiment, the apparatus may comprise an anvil without a spring, which anvil may be loaded against the elastomeric pusher surface and which anvil may then be launched by the elastomeric pusher surface after potential energy has been generated within the pusher surface.

In another embodiment, the spring anvil assembly comprises an elastomer 80 or a spring. The elastomer may be in the form of a compressible spring (sphere, cylindrical, hourglass) shape. The elastomer may be compressed against the pusher surface (by the drive mechanism, for example) to generate and store potential energy within the elastomer of the spring anvil assembly. After the elastomer is sufficiently compressed, the drive mechanism or other motive force may cease acting on the spring anvil assembly and/or elastomer to allow the elastomer to launch itself (and the spring anvil assembly) so that the anvil of the apparatus may drive a fastener. In another embodiment, the elastomer may be an element that does not itself launch along with the launched mass.

The drive mechanism may comprise, in an embodiment, a rack gear with intervals of teeth and no teeth. The drive mechanism preferably comprises a cam 52 and a cam follower 54 supported within the anvil assembly 44 by bearings 56 as illustrated in the figures. It will be apparent that the drive mechanism is configured to permit transition from an engagement period in which the potential energy of the elastomer, pusher surface and/or spring is increased to a disengagement period in which the generated potential energy is released and converted into kinetic energy in the anvil assembly. The drive mechanism is operatively coupled to the elastomer (whether the elastomer is part of the spring anvil assembly or part of the pusher surface) and/or the spring anvil assembly to allow the potential energy within the elastomer to increase. It will be apparent that when the drive mechanism decouples, the accumulated potential energy from the elastomer and/or spring is converted to kinetic energy, which kinetic energy is imparted on the spring anvil assembly and/or anvil, and the spring anvil assembly is launched and travels toward, and the anvil eventually contacts and drives, a fastener.

In an embodiment, the drive mechanism engages and actuates the spring anvil assembly to store potential energy, which actuation of the spring anvil assembly may be referred to as an "energized position" of the spring anvil assembly.

An advantage of using a cam is that the cam profile can be altered to compensate for pressure and load changes on the piston, which allows for a more optimal motor and drive mechanism design. In an embodiment, the cam profile of the cam is configured such that the motor torque varies no more than 30% during the majority of the operational cycle in which potential energy is being stored. Even more preferably, the torque is within a +/−30% band of the nominal loaded value for at least 70% of the cam rotation in potential energy is being generated. The drive mechanism thereafter disengages by having the cam 52 release from cam follower 54, allowing potential energy to act on the spring anvil assembly, causing the anvil to move (launched) toward and eventually drive a fastener. For at least one portion of this movement, the spring anvil assembly may separate from the pusher surface 48 and the entire spring anvil assembly may move to drive the fastener (as will be described in further detail below). During this portion, the spring ceases to exert an accelerating force on the spring anvil assembly. The drive mechanism is timed and/or configured using a sensor 90 for example to prevent further engagement with the spring anvil assembly until after the anvil and/or anvil assembly has returned to an approximate starting position. The drive mechanism may thereafter again act on the spring anvil assembly) to again store potential energy within the spring and/or elastomer and may thereafter again temporarily cease to act on the spring anvil assembly) to allow potential energy to instead act on the anvil assembly.

The anvil assembly is operatively coupled to the elastomer, such that when the drive mechanism ceases to exert a force on the spring anvil assembly and/or elastomer the potential energy stored within the elastomer converts to kinetic energy that causes the anvil assembly to move in a direction towards the fastener and for at least a portion of the fastener drive to have the spring anvil assembly separate from the pusher surface and/or elastomer and drive a fastener, for example. The anvil 62 and/or anvil assembly may be operatively coupled to a guide, shaft, or other structure that limits and guides the range of motion of the anvil and/or anvil assembly.

A sensor 90 is provided for determining at least one of the position of the drive mechanism and the spring anvil assembly. The sensor may enable proper sequencing for actuation or stopping of the operational cycle. Additionally, the sensor can be used to determine if there has been a fastener jam during the operational cycle. In one example, the sensor is located near an initial position of the spring anvil assembly. A sensor located in this configuration could indicate readiness of the apparatus to start a cycle as well as if the cycle had completed without a jam, for example.

It was unexpectedly discovered in this disclosure that the use of at least one bumper 70 for absorbing a portion of the force of impact of the anvil greatly extended the life of the apparatus. It was further unexpectedly discovered that an additional bumper 72 that may be disposed between the spring anvil assembly and the pusher surface also reduced wear. (In an embodiment, said bumper may also be the pusher surface 48.) In another embodiment a still further bumper 74 may be disposed between the anvil assembly against a feeder or frame of the apparatus (feeder and frame not shown) to reduce wear on the components of the apparatus. The at least one bumper may be of an elastic material, and may be disposed on the apparatus at any position where it is capable of absorbing a portion of the various impact energies. The bumper more preferably is composed of a material with a coefficient of restitution of less than 50%.

The apparatus may further comprise a return mechanism 64 to enable the spring anvil assembly to return to a position where it can be again contacted and/or acted on by the drive mechanism. This return mechanism is preferably passive but can be powered such as from a motor or the like. In an embodiment, the return mechanism is a return spring that is disposed on or in a guide rod. In a more preferred embodiment, the return spring is a gas spring that is contained within the thrown mass. In a still further embodiment, the return mechanism comprises at least one elastomeric compound such as a gum rubber, silicone rubber or the like. After the anvil moves, and after or in connection with the anvil impacting and driving a fastener, the return mechanism imparts a force on the anvil and/or spring anvil assembly to cause the spring anvil assembly to return to a position where the elastomer and/or spring anvil assembly is again in a position to store or ready to generate potential energy when operatively acted upon by the drive mechanism. In the embodiment where the return mechanism is a return spring or elastomer the return mechanism may be disposed with respect to the anvil such that motion of the anvil toward a fastener to be driven also causes an increase in potential energy in the return mechanism, and motion away from the fastener causes the return mechanism to release the stored potential energy and to actuate the spring anvil assembly to the anvil's earlier or original position. In a still further embodiment, where the return mechanism is a return spring or elastomer, the ratio of return mechanism force to spring anvil assembly weight results in an acceleration of at least 50 inches/second$^2$.

In a further embodiment, the spring anvil assembly is primarily composed of aluminum, magnesium, plastic or other low density materials to reduce the total moving mass weight. In a further embodiment, the total moving mass weight to apparatus weight is less than 25% and more preferably less than 10%.

In a further embodiment, an intermediate stoppage point is provided within the drive mechanism. This allows the drive mechanism 50 to stop and retain the partially energized elastomer prior to imparting a force on the anvil and/or anvil assembly. In an embodiment, the stoppage point is anywhere from approximately 50% of the compression or tension of the elastomer to 90% of the compression or tension of the elastomer. The storage of a portion of the total potential energy used during a cycle of the apparatus allows for an improved user experience by reducing the latency. Although the mechanism may be a modified pawl 53 and cam 52, it is apparent that the depicted mechanism is exemplary and that other devices for stopping and retaining the drive mechanism may be provided, such as a wrap spring or a one-way clutch. This embodiment allows for a significant improvement in the user experience and yet because of the design of the apparatus retains significant safety over other designs in that the motor must be re-energized to allow the fastener driving mechanism to drive the fastener. In the case of a preferred motor such as a brushless motor, this is an unlikely event due to the method in which brushless motors are controlled.

The present disclosure offers the following advantages: the gas spring and/or elastomer is capable of generating a relatively high amount of force in a small amount of space such that the size of the apparatus may be smaller than other fastener drivers. Furthermore, the disclosed apparatus has an improved safety profile. For example, if a nail becomes jammed, the potential energy of the spring anvil assembly does not act directly on the fastener, and thus when the user removes the jammed fastener, there is reduced potential for injury. The present disclosure also has an improved recoil force as opposed to conventional and prior fastener driving devices. This improvement arises in part as the anvil/anvil assembly is a free traveling mass within the fastener driving apparatus for at least part of the cycle. As such during the course of the driving of the fastener the apparatus does not put additional reactionary force on the operator when the fastener is driven. For purposes of this disclosure, "free traveling mass" and "free flight", means that the spring anvil assembly or anvil assembly has disengaged from the drive mechanism and the piston is no longer exerting an accelerating force on the anvil assembly. During this free flight, the anvil assembly may be in frictional contact with a guiding system and may be in contact with the fastener and the return mechanism. In contrast and in prior art tools and patents such as U.S. Pat. No. 8,602,282, air pressure on the piston and anvil assembly acts during the entire drive and the end of the stroke can result in significant recoil to the operator, especially in the case of a jam or a nail fired into a hard substrate or in the case of larger nails such as framing nails.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the disclosure and various embodiments with various modifications as are suited to the particular use contemplated.

What is claimed is:

1. A fastener driving apparatus, the apparatus comprising
a power source,
a control circuit,
a motor,
a spring anvil assembly, said spring anvil assembly comprising a spring and an anvil,
a pusher surface,
a drive mechanism capable of selectively engaging and disengaging said spring anvil assembly,
a pusher plate, wherein said spring anvil assembly ceases to act on a pusher plate prior to said anvil completing 50% of the drive of a fastener,
wherein when said drive mechanism selectively engages said spring anvil assembly potential energy is increased in at least one of said pusher surface and said spring anvil assembly and when said drive mechanism disengages said spring anvil assembly, potential energy from at least one of said pusher surface and said spring anvil assembly decreases while accelerating the spring anvil assembly to drive a fastener,
wherein during at least a portion of said drive stroke said drive mechanism disengages said spring anvil assembly does not exert an accelerating force on said anvil.

2. The fastener driving apparatus of claim 1, said spring having a stroke of movement and said anvil assembly having a stroke of movement, wherein the total stroke of said spring is no more than 50% of the total stroke of said spring anvil assembly.

3. The fastener driving apparatus of claim 1, wherein when said spring anvil assembly ceases to exert force on the pusher surface or spring at less than 40% of the total fastener stroke.

4. The fastener driving apparatus of claim 1, wherein said control circuit further comprises at least one sensor, wherein said at least one sensor may determine at least one of the position of said spring anvil assembly and the position of said drive mechanism.

5. The fastener driving apparatus of claim 1, wherein the drive mechanism comprises an intermediate stoppage point for storing or retaining of potential energy in the spring anvil assembly while the motor is de-energized and wherein the latency after the drive mechanism is restarted from said intermediate stoppage point is less than 100 milliseconds.

6. The fastener driving apparatus of claim 1, said apparatus comprising a bumper for absorbing the impact of the spring anvil assembly during an operational cycle of the apparatus.

7. The fastener driving apparatus of claim 1, further comprising a return mechanism for biasing said spring anvil assembly to a position where said spring is in a position to be re-energized.

8. A fastener driving apparatus, the apparatus comprising
a power source,
a control circuit,
a motor,
a spring anvil assembly, said spring anvil assembly comprising a spring and an anvil,
a pusher surface,
a drive mechanism capable of selectively engaging and disengaging said spring anvil assembly, said drive mechanism comprises a cam, said cam comprising a cam profile,
wherein said cam profile is configured such that during the portion of the operational cycle in which the spring anvil assembly is being energized, the required torque to operate the cam varies no more than 30% for at least 70% of the cam rotation in which the gas spring is being energized,
wherein when said drive mechanism selectively engages said spring anvil assembly potential energy is increased in at least one of said pusher surface and said spring anvil assembly and when said drive mechanism disengages said spring anvil assembly, potential energy from at least one of said pusher surface and said spring anvil assembly decreases while accelerating the spring anvil assembly to drive a fastener,
wherein during at least a portion of said drive stroke said drive mechanism disengages said spring anvil assembly does not exert an accelerating force on said anvil.

9. The fastener driving apparatus of claim 8, said spring having a stroke of movement and said anvil assembly having a stroke of movement, wherein the total stroke of said spring is no more than 50% of the total stroke of said spring anvil assembly.

10. The fastener driving apparatus of claim 8, wherein when said spring anvil assembly ceases to exert force on the pusher surface or spring at less than 40% of the total fastener stroke.

11. The fastener driving apparatus of claim 8, wherein said control circuit further comprises at least one sensor, wherein said at least one sensor may determine at least one of the position of said spring anvil assembly and the position of said drive mechanism.

12. The fastener driving apparatus of claim 8, wherein the drive mechanism comprises an intermediate stoppage point for storing or retaining of potential energy in the spring anvil assembly while the motor is de-energized and wherein the latency after the drive mechanism is restarted from said intermediate stoppage point is less than 100 milliseconds.

13. The fastener driving apparatus of claim 8, said apparatus comprising a bumper for absorbing the impact of the spring anvil assembly during an operational cycle of the apparatus.

14. The fastener driving apparatus of claim 8, further comprising a return mechanism for biasing said spring anvil assembly to a position where said spring is in a position to be re-energized.

15. A fastener driving apparatus, the apparatus comprising a power source, a control circuit, a motor, a spring anvil assembly, said spring anvil assembly comprising a spring and an anvil, a pusher surface, a drive mechanism capable of selectively engaging and disengaging said spring anvil assembly, wherein when said drive mechanism selectively engages said spring anvil assembly potential energy is increased in at least one of said pusher surface and said spring anvil assembly and when said drive mechanism disengages said spring anvil assembly, potential energy from at least one of said pusher surface and said spring anvil assembly decreases while accelerating the spring anvil assembly to drive a fastener, wherein during at least a portion of said drive stroke said drive mechanism disengages said spring anvil assembly does not exert an accelerating force on said anvil and wherein the mass of said spring anvil assembly is less than 15% of the mass of the apparatus.

16. The fastener driving apparatus of claim 15, said spring having a stroke of movement and said anvil assembly having a stroke of movement, wherein the total stroke of said spring is no more than 50% of the total stroke of said spring anvil assembly.

17. The fastener driving apparatus of claim 15, wherein when said spring anvil assembly ceases to exert force on the pusher surface or spring at less than 40% of the total fastener stroke.

18. The fastener driving apparatus of claim 15, wherein said control circuit further comprises at least one sensor, wherein said at least one sensor may determine at least one of the position of said spring anvil assembly and the position of said drive mechanism.

19. The fastener driving apparatus of claim 15, wherein the drive mechanism comprises an intermediate stoppage point for storing or retaining of potential energy in the spring anvil assembly while the motor is de-energized and wherein the latency after the drive mechanism is restarted from said intermediate stoppage point is less than 100 milliseconds.

20. The fastener driving apparatus of claim 15, said apparatus comprising a bumper for absorbing the impact of the spring anvil assembly during an operational cycle of the apparatus.

21. The fastener driving apparatus of claim 15, further comprising a return mechanism for biasing said spring anvil assembly to a position where said spring is in a position to be re-energized.

* * * * *